US010073403B2

(12) United States Patent
Shiraishi

(10) Patent No.: US 10,073,403 B2
(45) Date of Patent: Sep. 11, 2018

(54) IMAGE FORMATION APPARATUS THAT EXECUTES MISREGISTRATION CORRECTION

(71) Applicant: Oki Data Corporation, Tokyo (JP)

(72) Inventor: Toyokazu Shiraishi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/491,223

(22) Filed: Apr. 19, 2017

(65) Prior Publication Data

US 2017/0343949 A1 Nov. 30, 2017

(30) Foreign Application Priority Data

May 26, 2016 (JP) ..... 2016-104971

(51) Int. Cl.
*G03G 15/01* (2006.01)
*G03G 15/00* (2006.01)
*G03G 15/16* (2006.01)

(52) U.S. Cl.
CPC ..... *G03G 15/6558* (2013.01); *G03G 15/01* (2013.01); *G03G 15/16* (2013.01)

(58) Field of Classification Search
CPC ..... G03G 15/01; G03G 15/5041; G03G 15/5058; G03G 21/1633; G03G 21/18; G03G 2215/0158; G03G 2215/0161
USPC ..... 399/110, 111, 301
See application file for complete search history.

(56) References Cited

U.S. PATENT DOCUMENTS 9,291,974 B2 * 3/2016 Sugiyama ..... G03G 15/5058
9,310,744 B1 * 4/2016 Watanabe ..... G03G 15/5058

FOREIGN PATENT DOCUMENTS

JP 2001-134041 A 5/2001
JP 2004-069834 A 3/2004

* cited by examiner

*Primary Examiner* — William J Royer
(74) *Attorney, Agent, or Firm* — Metrolexis Law Group, PLLC

(57) ABSTRACT

An image formation apparatus that includes: first to third image formation units provided in this order in a traveling direction of a transfer target medium; a detector configured to detect first to third correction patterns formed on the transfer target medium by the first to third image formation units, respectively; and a control unit programed to control image misregistration correction based on a result of detection by the detector. The control unit causes the first and third image formation units to form the first and third correction patterns on the transfer target medium, respectively. When an amount of image misregistration between the first correction pattern and the third correction pattern is less than a predetermined value, the control unit neither causes the second image formation unit to form the second correction pattern, nor executes the image misregistration correction.

10 Claims, 11 Drawing Sheets

BLACK PATTERN

COLOR PATTERN

WHEN THERE IS NO MISREGISTRATION

WHEN COLOR PATTERNS ARE MISREGISTERED BY 2 DOTS LEFTWARD RELATIVE TO BLACK PATTERNS

BLACK PATTERN

COLOR PATTERN

WHEN THERE IS NO MISREGISTRATION

WHEN COLOR PATTERNS ARE MISREGISTERED BY 2 DOTS BACKWARD RELATIVE TO BLACK PATTERNS BACK

WHEN THERE IS NO MISREGISTRATION

WHEN COLOR PATTERNS ARE MISREGISTERED BY 3 DOTS BACKWARD RELATIVE TO BLACK PATTERNS BACK

IMAGE FORMATION APPARATUS THAT EXECUTES MISREGISTRATION CORRECTION

CROSS REFERENCE TO RELATED APPLICATIONS

This application claims priority based on 35 USC 119 from prior Japanese Patent Application No. 2016-104971 filed on May 26, 2016, entitled "IMAGE FORMATION APPARATUS", the entire contents of which are incorporated herein by reference.

BACKGROUND OF THE INVENTION

1. Field of the Invention

This disclosure is related to an image formation apparatus including multiple image formation units.

2. Description of Related Art

A color image formation apparatus which prints a color image generally includes multiple image formation units that are arranged in a conveyance direction (a traveling direction) of record media. Developer images of multiple colors formed by using the multiple image formation units are sequentially transferred onto a record medium to be conveyed. As a result, a color developer image, which is formed from the developer images of multiple colors overlapping one another, is formed on the record medium. The color developer image is fused onto the record medium by using a fuser, and formation of the color image is thus completed.

The color image formation apparatus executes color misregistration correction as image misregistration correction, for example, at points immediately after power is turned on, in the middle of a continuous printing operation, and immediately after a printing operation is completed (see Japanese Patent Application Publication No. 2004-69834 or Patent Document 1, for example). Here, the image misregistration means occurrence of misregistration between positions of the multiple developer images overlapping each other, and the color misregistration means occurrence of misregistration between positions of the developer images of the multiple colors overlapping each other. Meanwhile, the occurrence of the image misregistration or the color misregistration is mainly attributed to a slight change in a conveyance speed of the record medium (or a traveling speed of an intermediate transfer belt) caused by an increase or decrease in diameter of a roller, around which an endless conveyance belt to convey the record medium is wound (or the intermediate transfer belt is wound), along with a change in temperature inside the apparatus. In the meantime, the image misregistration correction means a control of operations of the image formation units, based on a detection of the amount of image misregistration, so as to reduce the amount of image misregistration, while the color misregistration correction means a control of operations of the image formation units, based on a detection of the amount of color misregistration, to reduce the amount of color misregistration (see Patent Document 1, for example).

SUMMARY OF THE INVENTION

However, a process to detect the amount of image misregistration (the amount of color misregistration) includes a subprocess to form a correction pattern being a developer image onto a transfer target medium such as the conveyance belt and the intermediate transfer belt. Accordingly, a printing operation on the record medium is interrupted during a period of executing this process. As a consequence, execution of detection of amounts of image misregistration (amounts of color misregistration) and correction of image misregistration with high frequency causes a problem of deterioration in productivity of printed matters.

An object of an embodiment of the invention is to improve productivity of printed matters by decreasing frequency of detection of amounts of image misregistration and frequency of image misregistration correction.

An aspect of the invention is an image formation apparatus that includes: a first image formation unit containing a first developer; a second image formation unit disposed downstream of the first image formation unit in a traveling direction of a transfer target medium, the second image formation unit containing a second developer; a third image formation unit disposed downstream of the second image formation unit in the traveling direction, the third image formation unit containing a third developer; a detector which detects a first correction pattern formed on the transfer target medium by the first image formation unit, a second correction pattern formed on the transfer target medium by the second image formation unit, and a third correction pattern formed on the transfer target medium by the third image formation unit; and a control unit programed to control image misregistration correction based on a result of detection by the detector. The control unit causes the first image formation unit to form the first correction pattern on the transfer target medium, and causes the third image formation unit to form the third correction pattern on the transfer target medium. When an amount of image misregistration between the first correction pattern and the third correction pattern is less than a predetermined value, the control unit neither causes the second image formation unit to form the second correction pattern, nor executes the image misregistration correction.

According to the aspect of the invention, it is possible to improve productivity of printing by decreasing frequency of detection of amounts of image misregistration and frequency of image misregistration correction.

DETAILED DESCRIPTION OF EMBODIMENTS

Figure 1:
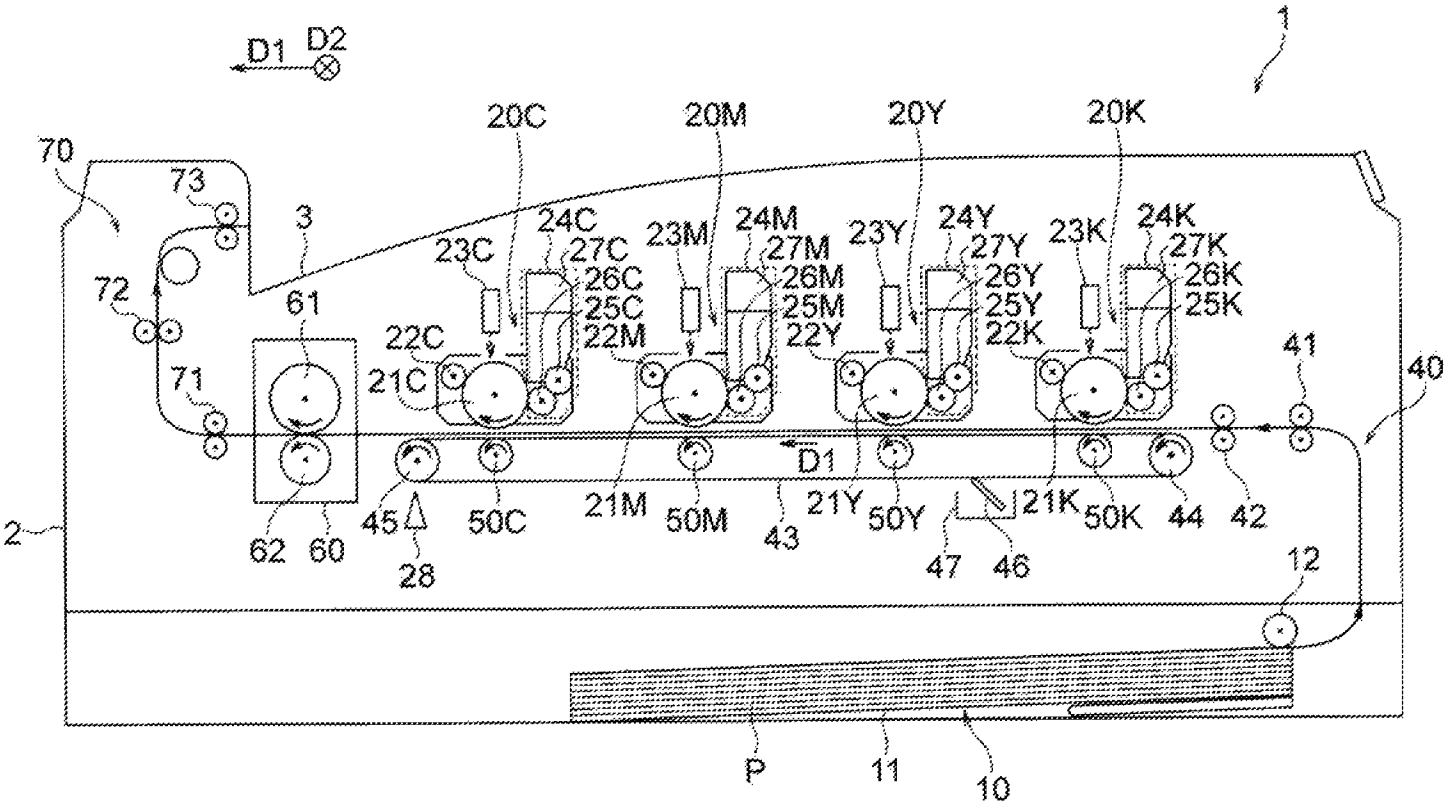
FIG. 1 is a cross-sectional view illustrating a schematic structure of an image formation apparatus according to one or more embodiments.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

<<1>> First Embodiment

<<1-1>> Configuration

FIG. 1 is a cross-sectional view illustrating a schematic structure of an image formation apparatus 1 according to one or more embodiments. Image formation apparatus 1 is a color printer which adopts electrophotography, for example.

As illustrated in FIG. 1, image formation apparatus 1 includes: multiple image formation units 20K, 20Y, 20M, and 20C which form developer images (toner images) on record medium P such as a sheet of paper; and medium supply unit (separation roller unit) 10 which supplies record medium P to multiple image formation units 20K, 20Y, 20M, and 20C. Moreover, image formation apparatus 1 includes: conveyance unit 40 which conveys record medium P supplied from medium supply unit 10; transfer rollers (transfer units) 50K, 50Y, 50M, and 50C disposed in such a way as to correspond to the multiple image formation units 20K, 20Y, 20M, and 20C, respectively; and a fuser 60 which causes the developer images (the toner images), transferred onto record medium P, to be fused onto record medium P. Furthermore, image formation apparatus 1 includes: medium discharge unit (sheet discharge unit) 70 which discharges record medium P that passes through fuser 60 onto stacker 3 located outside of housing 2 of image formation apparatus 1. While FIG. 1 illustrates four image formation units 20K, 20Y, 20M, and 20C arranged in a conveyance direction D1 of the record media, image formation apparatus 1 only needs to include at least three image formation units, and hence the number of the image formation units therein is not limited only to four. In addition, although FIG. 1 illustrates the case where image formation apparatus 1 is a printer, the invention is also applicable to any other apparatuses including copiers, facsimile machines, multifunction peripherals (MPF), and the like.

Medium supply unit 10 includes medium cassette (sheet cassette) 11, and separation roller (hopping roller) 12 that picks up record media P one by one which are loaded in medium cassette 11. Medium cassette 11 is attachable to and detachable from the inside of housing 2 of image formation apparatus 1. Record media P loaded inside medium cassette 11 are picked up one by one by separation roller 12, and paired conveyance rollers 41 and 42 of conveyance unit 40 cause record media P thus picked up to pass through a medium conveyance path defined between the set of image formation units 20K, 20Y, 20M, and 20C and the set of transfer rollers 50K, 50Y, 50M, and 50C.

Meanwhile, conveyance unit 40 includes: conveyance belt (transfer belt) 43 as a movably supported endless belt; driving roller 45 around which conveyance belt 43 is wound; tension roller (driven roller) 44 which stretches conveyance belt 43 in cooperation with driving roller 45 as a pair; cleaning blade 46 which scrapes off toners remaining on conveyance belt 43; and waste toner tank 47 which stores the toners scraped off by cleaning blade 46. Moreover, conveyance unit 40 includes: a drive force generation source (driving roller drive unit 45*a* in FIG. 2 to be described later) such as a motor serving as a mechanism to rotate driving roller 45; and a drive force transmission mechanism such as a gear mechanism which transmits the drive force generated by the drive force generation mechanism to driving roller 45.

Image formation units 20K, 20Y, 20M, and 20C are juxtaposed to one another (arranged in tandem) from an upstream side to a downstream side along the medium conveyance path and in the conveyance direction D1 of record medium as the transfer target medium, i.e., a running direction (the conveyance direction D1 in FIG. 1) of conveyance belt 43 on the image formation unit side. Image formation units 20K, 20Y, 20M, and 20C have basically the same structure except that colors of the toners used therein are different. Here, image formation units 20K, 20Y, 20M, and 20C are detachably attached to an apparatus body (a main structure of image formation apparatus 1) inside housing 2.

When an ordinary printing operation takes place, image formation units 20K, 20Y, 20M, and 20C form a black (K) toner image, a yellow (Y) toner image, a magenta (M) toner image, and a cyan (C) toner image, respectively, on record medium P as a transfer target medium to be conveyed in the conveyance direction D1.

Moreover, in this embodiment, image formation units 20K, 20Y, 20M, and 20C (or two out of these image formation units targeted for detection of the amount of image misregistration, for example) form a correction pattern being a black (K) toner image, a correction pattern being a yellow (Y) toner image, a correction pattern being a magenta (M) toner image, and a correction pattern being a cyan (C) toner image, respectively, on conveyance belt 43 as a transfer target medium that runs in the conveyance direction (the traveling direction) D1 in order to detect the amount of image misregistration. The toner images of the respective colors formed on conveyance belt 43 are detected with an optical sensor constituting detector 28. Detector 28 is used for detecting an amount of displacement between the correction patterns, which are the developer images transferred from certain image formation units out of image formation units 20K, 20Y, 20M, and 20C onto conveyance belt 43. In addition, detector 28 is also used for detecting a position in a main scanning direction (a direction D2 orthogonal to the conveyance direction D1) of each correction pattern.

Meanwhile, optical heads 23K, 23Y, 23M, and 23C, which are exposure devices (exposure heads) to perform exposure based on image data of the corresponding colors, are provided inside housing 2 in such a way as to be opposed to image formation units 20K, 20Y, 20M, and 20C, respectively. Optical heads 23K, 23Y, 23M, and 23C are attached to an inner surface of an upper cover of housing 2, for example. In this embodiment, optical head 23K is an LED (light emitting diode) array unit which performs the exposure based on black image data, optical head 23Y is an LED array unit which performs the exposure based on yellow image data, optical head 23M is an LED array unit which performs the exposure based on magenta image data, and optical head 23C is an LED array unit which performs the exposure based on cyan image data. Drive signals based on the image data of the corresponding colors are inputted to optical heads 23K, 23Y, 23M, and 23C, respectively, whereby light beams for exposure corresponding to the inputted drive signals are applied to photoconductor drums 21K, 21Y, 21M, and 21C, respectively. Note that optical heads 23K, 23Y, 23M, and 23C may instead be laser scan units adopting laser emission elements as light sources.

In general, image formation units 20K, 20Y, 20M, and 20C are formed from image drum units and toner cartridges 27K, 27Y, 27M, and 27C for toner supply attached to the image drum units. Meanwhile, in general, toner cartridges 27K, 27Y, 27M, and 27C include storage units such as semiconductor memories, which store information concerning toner cartridges 27K, 27Y, 27M, and 27C, respectively. In the meantime, image formation units 20K, 20Y, 20M, and 20C include read-write units, which write the information into the storage units and read the information out of the storage units, respectively. The image drum units of image formation units 20K, 20Y, 20M, and 20C include: photoconductor drums 21K, 21Y, 21M, and 21C serving as image carriers that are supported rotatably about the corresponding rotation centers; and charge rollers 22K, 22Y, 22M, and 22C serving as charging members which uniformly charge surfaces of photoconductor drums 21K, 21Y, 21M, and 21C. Meanwhile, the image drum units of image formation units 20K, 20Y, 20M, and 20C include development units (development devices) 24K, 24Y, 24M, and 24C which supply the toners to the surfaces of photoconductor drums 21K, 21Y, 21M, and 21C after electrostatic latent images are formed on the surfaces of photoconductor drums 21K, 21Y, 21M, and 21C by the exposure using optical heads 23K, 23Y, 23M, and 23C, and thus to form the toner images (the developer images) that correspond to the electrostatic latent images. Development units 24K, 24Y, 24M, and 24C include: development rollers 26K, 26Y, 26M, and 26C serving as developer carriers; and supply rollers 25K, 25Y, 25M, and 25C serving as supply members that supply the toners onto development rollers 26K, 26Y, 26M, and 26C.

Each of photoconductor drums 21K, 21Y, 21M, and 21C includes: a conductive support in the form of a pipe (a cylinder) made of a metal such as aluminum; and a photoconductive layer that covers a surface of the conductive support. Each of photoconductor drums 21K, 21Y, 21M, and 21C is rotated in a direction of the corresponding arrow in FIG. 1 (clockwise in FIG. 1) about the corresponding rotation center by a drive force from a drive unit such as a motor (drive unit 21*a* in FIG. 2 to be described later, for example).

In the meantime, transfer rollers 50K, 50Y, 50M, and 50C are disposed opposite to photoconductor drums 21K, 21Y, 21M, and 21C of image formation units 20K, 20Y, 20M, and 20C while interposing conveyance belt 43. Transfer rollers 50K, 50Y, 50M, and 50C sequentially transfer the developer images (the toner images) formed on the surfaces of photoconductor drums 21K, 21Y, 21M, and 21C of image formation units 20K, 20Y, 20M, and 20C onto an upper surface of record medium P, which is conveyed in the running conveyance direction D1 along the medium conveyance path, or onto an upper surface of conveyance belt 43. Thus, images (the correction patterns) are formed by overlapping the multiple toner images.

As illustrated in FIG. 1, fuser 60 includes a pair of rollers 61 and 62 which are brought into press-contact with each other, for example. Roller 61 is a heat roller incorporating a heater while roller 62 is a pressure roller to be pressed against roller 61. The developer images (the toner images) on record medium P, which are yet to be fused, are heated and pressed when record medium P passes through a clearance between the pair of rollers 61 and 62 of fuser 60, and are thus fused onto record medium P.

Medium discharge unit 70 includes conveyance roller pairs 71, 72, and 73, each of which includes two rollers that are in press-contact with and opposed to each other. Each of the rollers constituting conveyance roller pairs 71, 72, and 73 is connected to a drive unit, which is formed from: a drive force generation unit such as a motor; and a power transmission mechanism formed from gears and the like that transmit a rotational drive force generated by the drive force generation unit. Thus, rollers are rotated to convey record medium P.

The configuration of image formation apparatus 1 is not limited to the example of FIG. 1. For instance, image formation apparatus 1 may include a medium inversion mechanism, which inverts record medium P passing through fuser 60 and sends inverted record medium P to image formation units 20K, 20Y, 20M, and 20C.

Meanwhile, an intermediate transfer belt to which the toner images are transferred, and a secondary transfer roller which transfers the toner images on the intermediate transfer belt onto the record medium P, may be provided instead of conveyance belt 43. In this case, the correction patterns are formed on the intermediate transfer belt, and record medium P passes through a clearance between the intermediate transfer belt and the secondary transfer roller.

Figure 2:
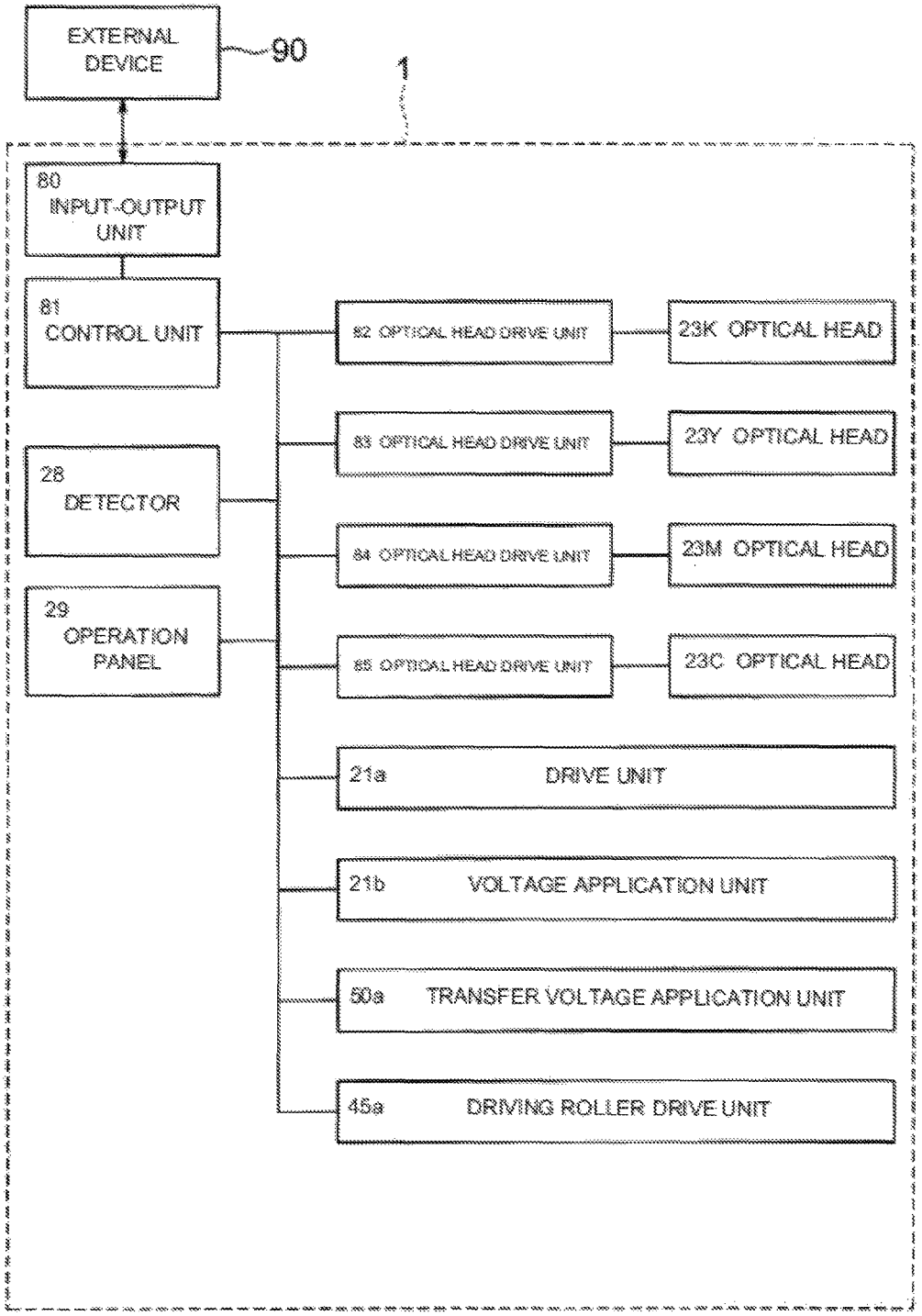
FIG. 2 is a block diagram schematically illustrating a substantial configuration of a control system in the image formation apparatus.

FIG. 2 is a block diagram schematically illustrating a configuration of a control system in image formation apparatus 1. As its control configuration, image formation apparatus 1 includes input-output unit (communication unit) 80 for performing communication with external device 90 such as a host computer, and control unit 81 which controls operations of the entirety of image formation apparatus 1 inclusive of multiple image formation units 20K, 20Y, 20M, and 20C. Image formation apparatus 1 also includes: optical head drive units 82, 83, 84, and 85 which drive (enable light emission of) optical heads 23K, 23Y, 23M, and 23C based on drive signals from control unit 81, drive unit 21*a* which drives photoconductor drums 21K, 21Y, 21M, and 21C, and the like of image formation units 20K, 20Y, 20M, and 20C; and driving roller drive unit 45*a* which rotates driving roller 45 that causes conveyance belt 43 to run. Moreover, image formation apparatus 1 includes voltage application unit 21*b* for applying voltages to photoconductor drums 21K, 21Y, 21M, and 21C, charge rollers 22K, 22Y, 22M, and 22C, development rollers 26K, 26Y, 26M, and 26C, and supply rollers 25K, 25Y, 25M, and 25C. Furthermore, image formation apparatus 1 includes transfer voltage application unit 50*a* for applying voltages to transfer rollers 50K, 50Y, 50M, and 50C. Even further, image formation apparatus 1 includes detector 28 which optically detects the correction patterns, and operation panel 29 serving as an operation unit to which user instructions are inputted.

Control unit 81 includes, for example: a CPU (central processing unit); and a storage unit including a ROM (read only memory), a RAM (random access memory), a hard disk, a flash memory, and the like. A variety of control processing is carried out by causing the CPU to read programs out of the storage unit and to execute the programs. Control unit 81 controls image formation unit 20K, 20Y, 20M, and 20C to form the correction patterns on conveyance belt 43 for image misregistration correction (color misregistration correction) processing. Based on a detection result of the correction patterns detected by detector 28, control unit 81 controls light emission timings of optical heads 23K, 23Y, 23M, and 23C, and controls positions of light emission in the main scanning direction of optical heads 23K, 23Y, 23M, and 23C.

Next, a description is given of detection of the amount of color misregistration as the amount of image misregistration. A technique for detection of the amount of color misregistration is described in Japanese Patent Application Publication No. 2001-134041, for example.

Figures 3A, 3B:
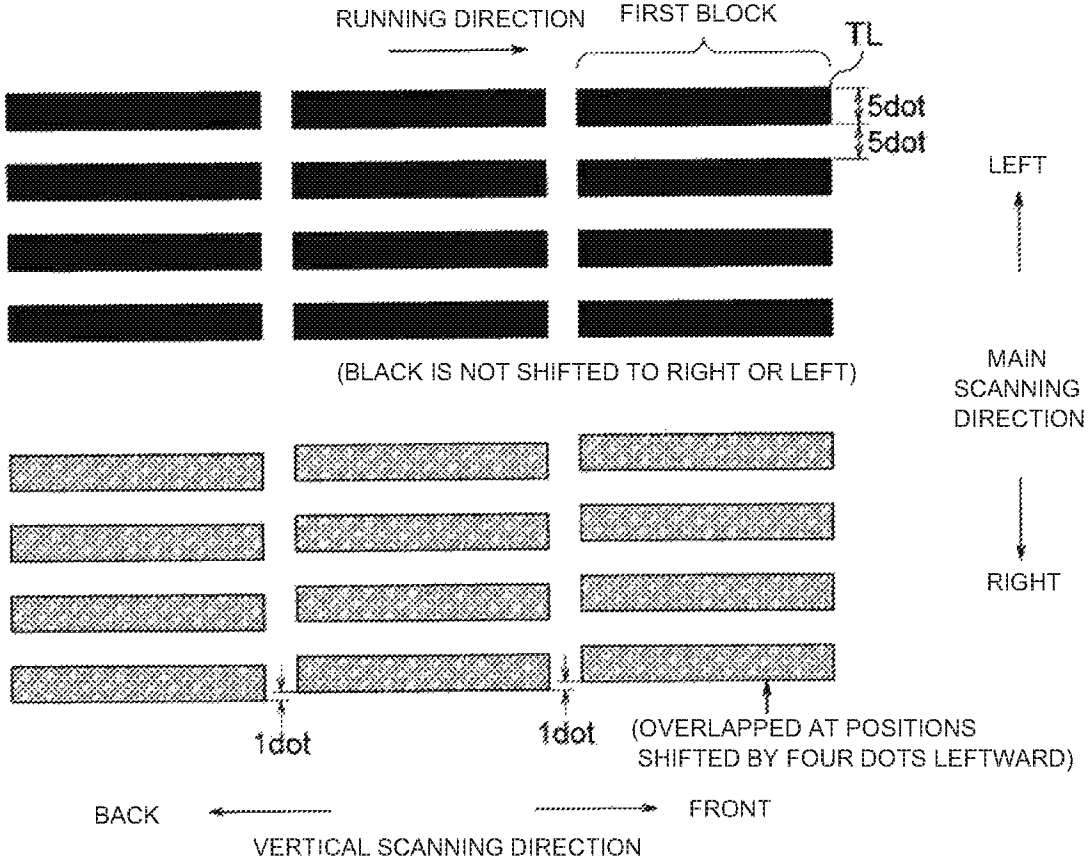
FIGS. 3A and 3B are diagrams illustrating enlarged correction patterns for three blocks to be printed on a conveyance belt.
Figures 4A, 4B:
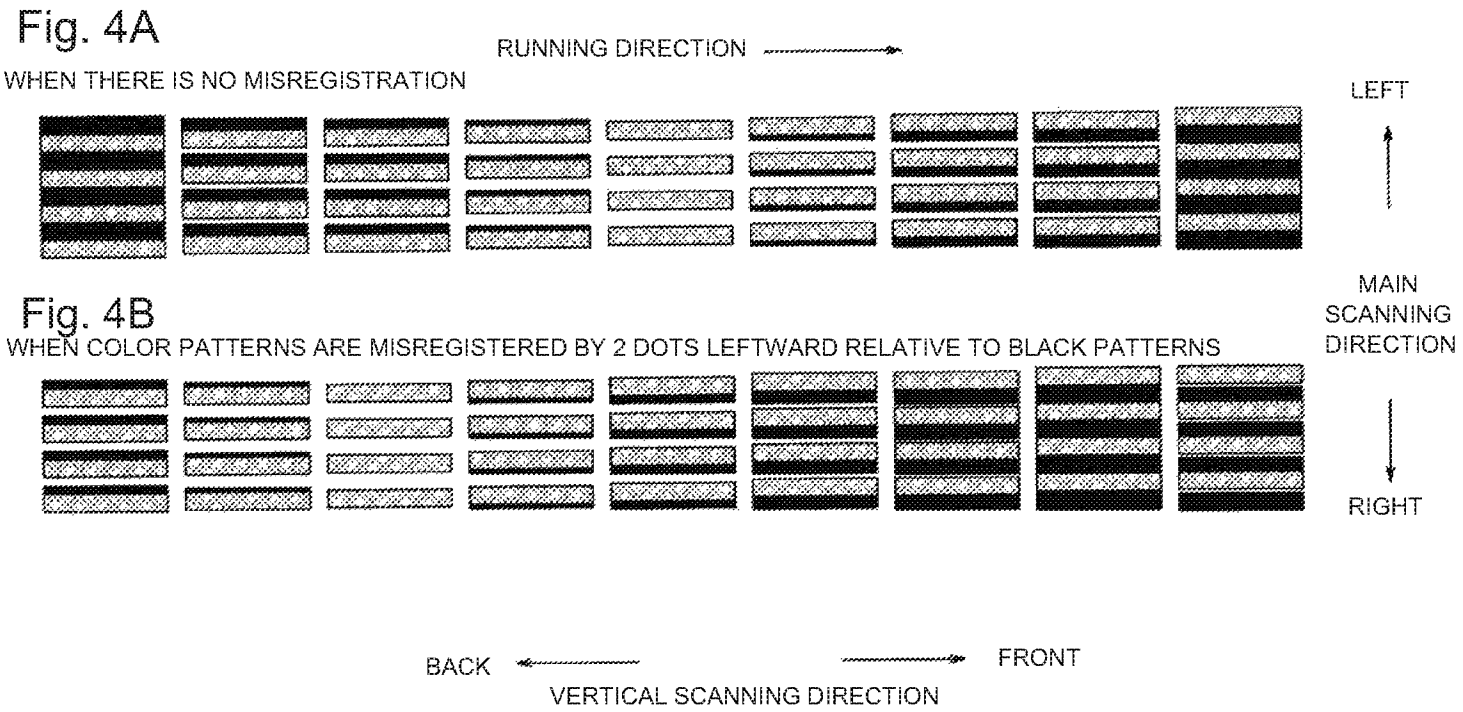
FIGS. 4A and 4B are diagrams illustrating an overall configuration of correction patterns used for detecting an amount of color misregistration in a main scanning direction.

FIGS. 3A and 3B are plan views illustrating enlarged correction patterns for three blocks to be printed on conveyance belt 43. FIGS. 4A and 4B are plan views illustrating an overall configuration of the correction patterns used for detecting the amount of color misregistration in the main scanning direction.

FIG. 3A illustrates black correction patterns while FIG. 3B illustrates color (any one of yellow, magenta, and cyan) correction patterns. Here, the black correction patterns and the color correction patterns are illustrated as separate patterns. However, in reality, the black correction patterns are first printed on conveyance belt 43 and then the color correction patterns of any of yellow, magenta, and cyan are printed in an overlapping manner on the black correction patterns. In FIGS. 3A and 3B, conveyance belt 43 is made to run in the running direction, and meanwhile, blocks on the fourth and subsequent rows are not illustrated therein.

As illustrated in FIG. 3A, the black correction patterns to be printed first are four lines of striped correction patterns with a width of five dots each, which are drawn perpendicularly to the main scanning direction at intervals of five dots, respectively. Here, the four lines of striped correction patterns are defined as one block, and nine blocks of the striped correction patterns are linearly arranged in the running direction of the belt at given intervals in the vertical scanning direction (see FIGS. 4A and 4B). Note that the four lines in each block are arranged at the same position in terms of the main scanning direction.

Meanwhile, regarding the color correction patterns illustrated in FIG. 3B, structures of the respective blocks per se are the same as the arrangement of the black correction patterns. Here, printing positions in the vertical scanning direction of the color correction patterns are set in such a way as to overlap the first block of the black correction patterns based on a position TL of the first block of the black correction patterns in the front to be printed first as a reference. On the other hand, arrangement positions of the front block in the main scanning direction of the color correction patterns are set at such printing positions that are shifted by four dots leftward from the black correction patterns. Moreover, in the second and later blocks to be printed subsequent to the first block in the vertical scanning direction, printing positions thereof are set in such a way as to be shifted by one dot rightward from the precedent block, respectively.

As illustrated in FIGS. 4A and 4B, the correction patterns formed from the black striped correction patterns and the color correction patterns set to the above-described arrangement are designed such that the black correction patterns printed earlier on conveyance belt 43 are covered with the color correction patterns to be printed later. Accordingly, proportions of overlap between the two types of the correction patterns vary among the blocks corresponding to the misregistration in printing positions in the main scanning direction of the color correction patterns relative to the black correction patterns as illustrated in FIGS. 4A and 4B, respectively. When the two types of the correction patterns overlap each other as described above, the color toner and the black toner located therebelow are yet to be fused onto conveyance belt 43. Accordingly, the black correction patterns covered with the color correction patterns are not seen through.

In the case of FIG. 4A where there is no misregistration of the printing positions in the main scanning direction, the two types of the correction patterns completely overlap one another at the fifth block counted from the front in the vertical scanning direction. Meanwhile, FIG. 4B illustrates the case where the printing positions of the color correction patterns are misregistered by two dots leftward in the main scanning direction relative to the black correction patterns. Here, the two types of the correction patterns completely overlap one another at the seventh block counted from the front in the vertical scanning direction. According to the nine blocks of the correction patterns described above, the number of the block of the correction patterns where the correction patterns completely overlap one another varies in accordance with the misregistration of the printing positions by the dot. As a consequence, if there is the misregistration of the printing positions in the main scanning direction, the misregistration can be detected as long as the range of misregistration falls within four dots in the right-left direction.

Figures 5A, 5B:
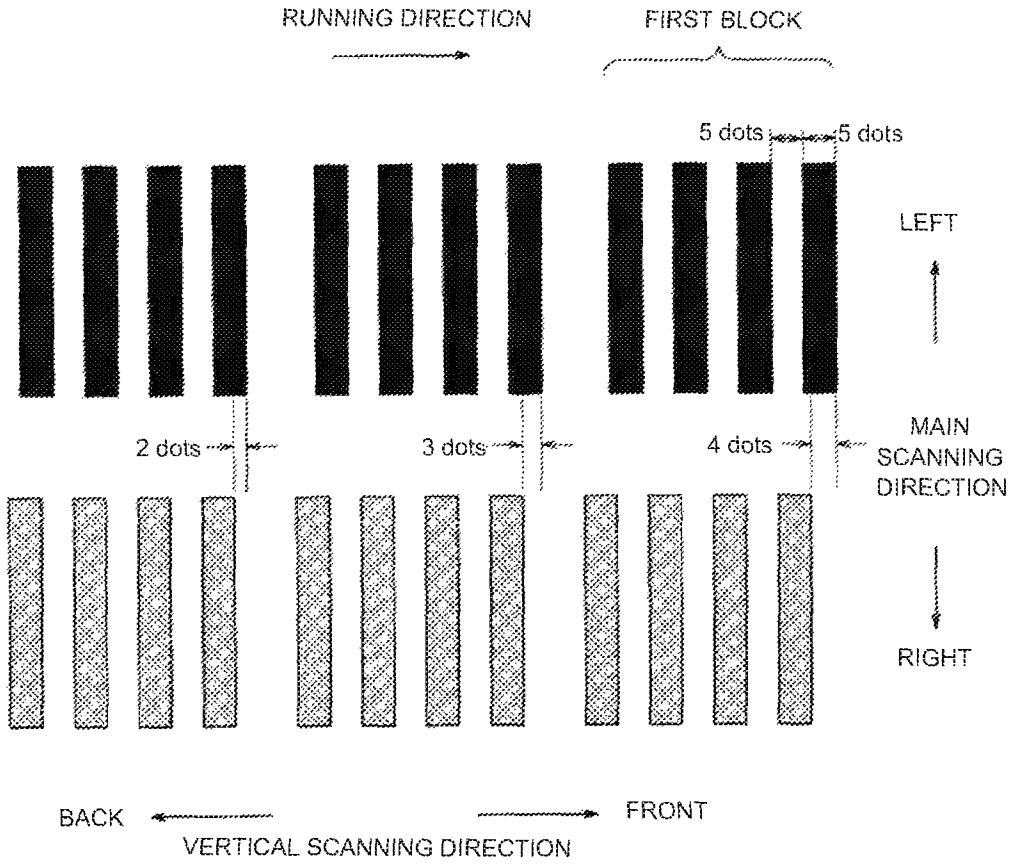
FIGS. 5A and 5B are diagrams illustrating enlarged correction patterns for just three blocks used for detecting an amount of color misregistration in a vertical scanning direction.
Figures 6A, 6B:
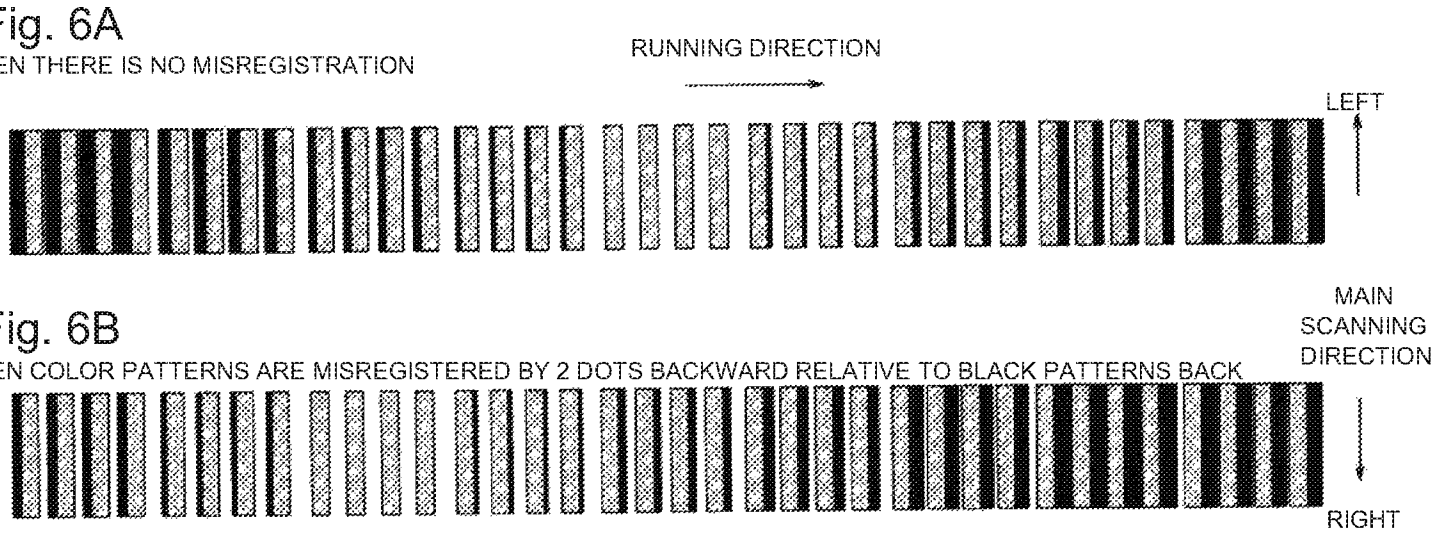
FIGS. 6A and 6B are diagrams illustrating an overall configuration of correction patterns in the vertical scanning direction.

Next, a description is given below of correction patterns to be used for correcting printing positions in the vertical scanning direction (the conveyance direction D1). FIGS. 5A and 5B are diagrams illustrating enlarged correction patterns for three blocks used for detecting the amount of color misregistration in the vertical scanning direction. FIGS. 6A and 6B are diagrams illustrating an overall configuration of the correction patterns in the vertical scanning direction.

FIG. 5A illustrates black correction patterns while FIG. 5B illustrates color (any one of yellow, magenta, and cyan) correction patterns. Here, as with the ones used for detection of the color misregistration in the main scanning direction, these correction patterns are in fact printed in an overlapping manner on the conveyance belt. As illustrated in FIG. 5A, the black correction patterns to be printed first are four lines of striped correction patterns with a width of five dots each, which are drawn perpendicularly to the vertical scanning direction at intervals of five dots, respectively. Here, the four lines of the striped correction patterns are defined as one block, and nine blocks of the striped correction patterns are linearly arranged in the running direction of the belt at given intervals in the vertical scanning direction (see FIGS. 6A and 6B). Here, the four lines in each block are arranged at the same position in terms of the main scanning direction.

Meanwhile, regarding the color correction patterns illustrated in FIG. 5B, structures of the respective blocks per se are the same as the arrangement of the black correction patterns. Regarding the main scanning direction, printing positions of the respective blocks are set in such a way as to overlap the black correction patterns with ends in the right-left direction in alignment with one another. On the other hand, arrangement positions of the front block in the vertical scanning direction thereof are set at such printing positions that are shifted by four dots backward in the vertical scanning direction from the black correction patterns. Moreover, printing positions of the color correction patterns of the second block are arranged at such printing positions that are shifted by three dots backward in the vertical scanning direction from the black correction patterns. Likewise, in the respective blocks to be subsequently printed behind in the vertical scanning direction, the shift amount is decremented by one dot for each block from the immediately precedent block. As a consequence, the color correction patterns of the final ninth block are arranged at printing positions shifted by four dots forward in the vertical scanning direction.

When the black and color striped correction patterns arranged as described above are printed in an overlapping manner on conveyance belt 43, proportions of overlap between the two types of the correction patterns vary among the blocks corresponding to the amount of image misregistration in the vertical scanning direction of the color correction patterns relative to the black correction patterns as illustrated in FIGS. 6A and 6B, respectively. In the case of FIG. 6A where there is no misregistration of the printing positions in the vertical scanning direction, the two types of the correction patterns completely overlap one another at the fifth block counted from the front in the vertical scanning direction. Meanwhile, FIG. 6B illustrates the case where the printing positions of the color correction patterns are misregistered by two dots backward in the vertical scanning direction relative to the black correction patterns. Here, the two types of correction patterns overlap one another at the seventh block counted from the front in the vertical scanning direction. According to the nine blocks of the correction patterns described above, the misregistration of the printing positions can also be detected in the range of about four dots in the vertical scanning direction as with the detection of the color misregistration in the main scanning direction.

Figure 7A:
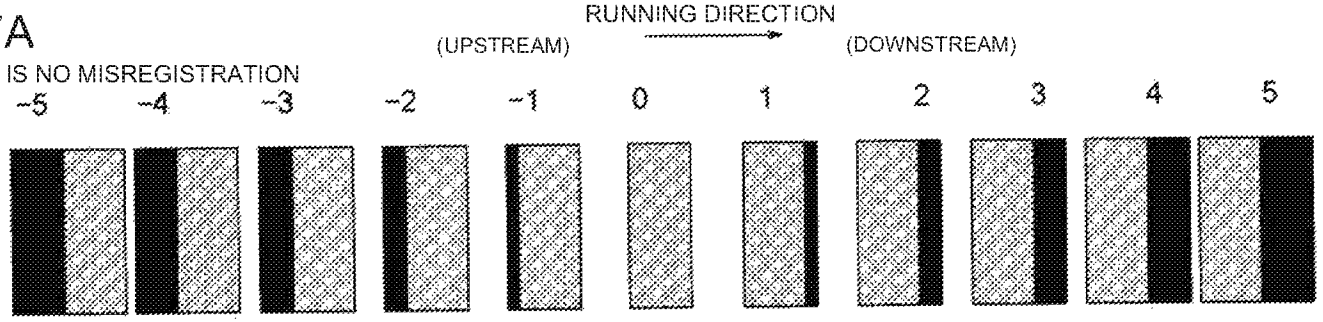
FIGS. 7A and 7B are diagrams illustrating different correction patterns used for detecting an amount of color misregistration in the vertical scanning direction.
Figure 7B:
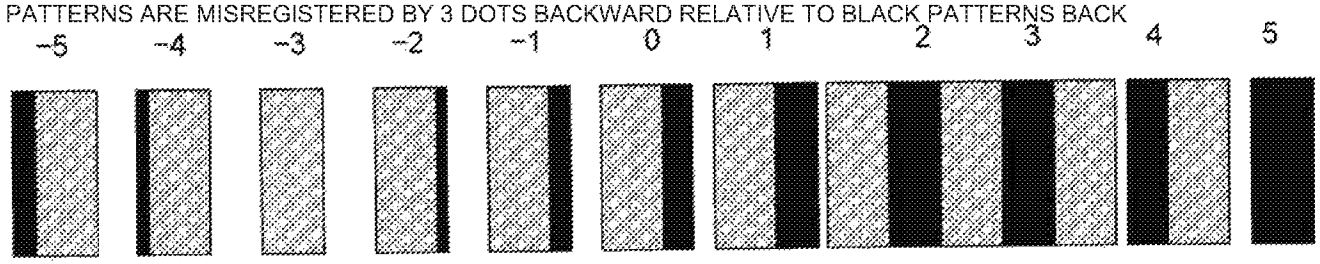

The correction patterns, in which each block is formed from four lines in order to detect the amount of color misregistration in the vertical scanning direction, are described in FIGS. 6A and 6B. However, it is also possible to detect the misregistration of the printing positions similarly by using correction patterns in which each block consists of one line. FIGS. 7A and 7B are diagrams illustrating different correction patterns for detecting the amount of color misalignment in the vertical scanning direction. The blocks each consisting of one line can detect the color misregistration in the same size even by reducing the length of the entire correction patterns, and therefore have an effect of a capability of reducing the time spent for the detection of color misregistration.

<<1-2>> Operations

Figure 8A:
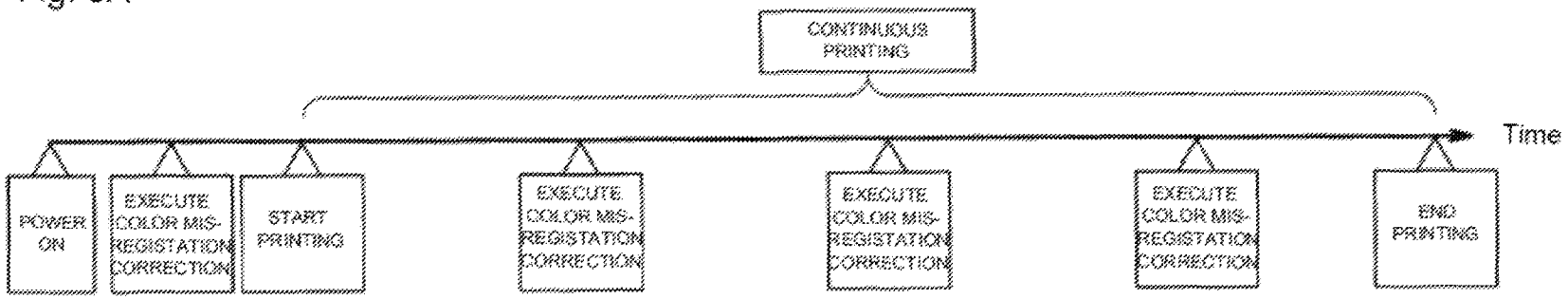
Prior Art Fig. 8A
FIG. 8A is a sequence diagram illustrating control for color misregistration correction in the course of continuous printing with an image formation apparatus of a comparative example.
Figure 8B:
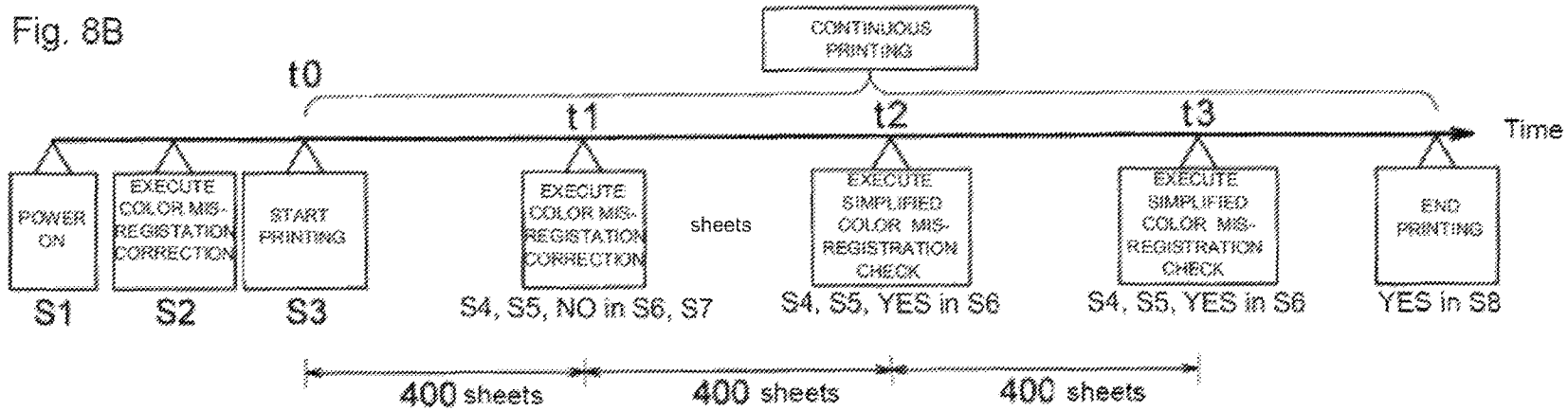
FIG. 8B is a sequence diagram illustrating control for color misregistration correction in the course of continuous printing with the image formation apparatus of FIG. 1.
Figure 9:
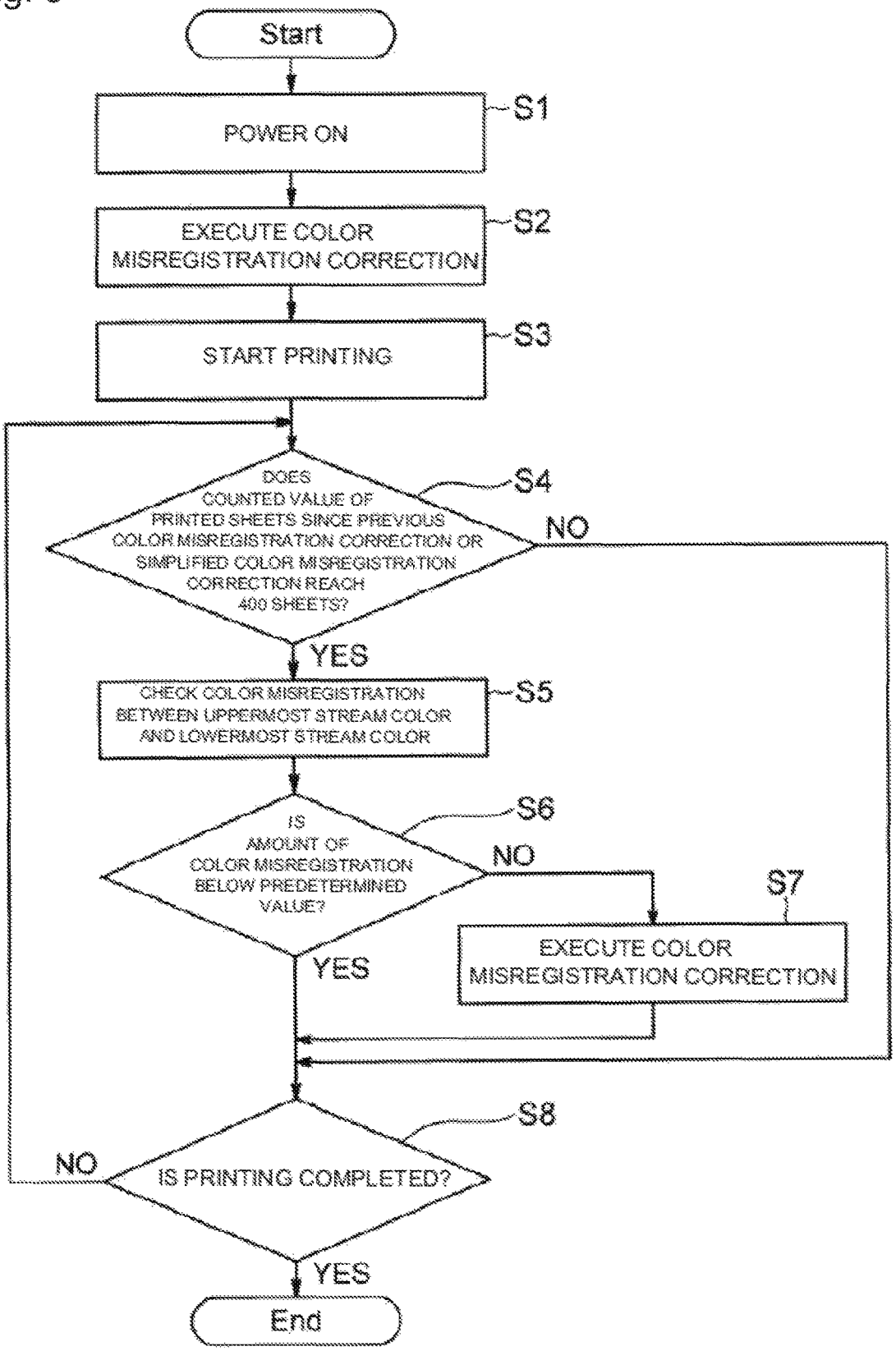
FIG. 9 is a flowchart illustrating operations of the image formation apparatus.

FIG. 8A is a sequence diagram illustrating control for color misregistration correction in the course of continuous printing with an image formation apparatus of a comparative example, and FIG. 8B is a sequence diagram illustrating control for the color misregistration correction in the course of continuous printing with image formation apparatus 1 according to one or more embodiments. FIG. 9 is a flowchart illustrating operations of image formation apparatus 1 according to one or more embodiments.

As illustrated in FIGS. 8B and 9, when image formation apparatus 1 is powered on (by manipulating operation panel 29 of FIG. 2, for example) (step S1), image formation apparatus starts an initial operation and executes the color misregistration correction command (step S2). In the color misregistration correction operation, the correction patterns formed from the developer images (the toner images) of two colors are transferred onto conveyance belt 43 as the transfer target medium. Then, the degree of overlap of the toner images of the two colors is optically detected by detector 28, and the amount of color misregistration representing the amount of image displacement is detected, based on the detection result of the overlap degree, by control unit 81. The correction patterns are formed as a combination of a reference color and an adjustment target color (any one of cyan, magenta, and yellow, for example). The image formation unit located at the uppermost stream of conveyance belt 43 of the image formation apparatus (20K in the first embodiment) is used to determine the reference color.

In the first process to begin with, control unit 81 controls operations of the image formation units such that the black (K) correction patterns of the reference color and the cyan (C) correction patterns are formed on conveyance belt 43, the amount of color misregistration (the amount of color misregistration between K-C) is detected by detector (a color misregistration sensor) 28, and the color misregistration correction is carried out in accordance with the amount of color misregistration (so as to reduce or more preferably eliminate the amount of color misregistration).

In the next second process, control unit 81 controls operations of the image formation units such that the black (K) correction patterns of the reference color and the magenta (M) correction patterns are formed on conveyance belt 43, the amount of color misregistration (the amount of color misregistration between K-M) is detected by detector (the color misregistration sensor) 28, and the color misregistration correction is carried out in accordance with the amount of color misregistration (so as to reduce or more preferably eliminate the amount of color misregistration).

In the next third process, control unit 81 controls operations of the image formation units such that the black (K) correction patterns of the reference color and the yellow (Y) correction patterns are formed on conveyance belt 43, the amount of color misregistration (the amount of color misregistration between K-Y) is detected by detector (the color misregistration sensor) 28, and the color misregistration correction is carried out in accordance with the amount of color misregistration (so as to reduce or more preferably eliminate the amount of color misregistration). Note that the order of the first to third processes is not limited to the above-mentioned example of enumeration.

As illustrated in FIGS. 8B and 9, control unit 81 starts printing when a print instruction (a print job) is inputted from external device 90 (step S3). When the inputted print job represents continuous printing to perform printing continuously on multiple sheets, the color misregistration correction command is executed after the printing of a predetermined number of sheets is executed (in other words, in the course of the continuous printing). Such a predetermined number of sheets is set to 400 sheets, for example. This is due to the following reason. Specifically, at a point immediately after the power is turned on, the temperature inside the apparatus is assumed to be low as a consequence of being in a sleep mode for a long time. When the color misregistration correction command is carried out in this state, the color misregistration is usually corrected to an optimum value for the condition at this temperature inside the apparatus (at the low temperature). As the printing is started and the temperature inside the apparatus is raised, the diameters of driving roller 45 and driven roller 44 for driving the transfer belt may be changed, and it is highly likely that the most recent value of color misregistration correction is no longer useful for achieving the optimum printing result. That is why the color misregistration correction command is carried out in the course of the continuous printing (after the printing on about 400 sheets).

In step S4, it is determined whether or not a counted value of the printed sheets from the previous misregistration correction command (either color misregistration correction operation or simplified color misregistration check to be described later) reaches 400 sheets. Here, step S5 is performed if the counted value reaches 400 sheets (YES in step S4). In step S5, the amount of color misregistration between the black (K) correction patterns of the reference color and the cyan (C) correction patterns (the amount of color misregistration between K-C) is checked, and a determination is made in step S6 as to whether or not the amount of color misregistration is equal to or above a predetermined value or below the predetermined value. Step S7 is performed if the amount of color misregistration is equal to or above the predetermined value (NO in step S6). Step S8 is performed if the amount of color misregistration is below the predetermined value (YES in step S6).

At the first round of the color misregistration correction command (at time point t1 in FIG. 8B) counted from a point of detection of the start of continuous printing (at time point t0 therein), the determination in step S6 usually turns out to be NO since a large amount of color misregistration is apt to be detected. As a consequence, ordinary color misregistration correction operation (including the first to third processes described above) is executed in step S7. In this case, after the color misregistration detection of the first process is executed in step S5, the color misregistration correction of the first process and the color misregistration detections and the color misregistration corrections of the second process and the third process are executed in step S7, or the entire of the first to third process are executed in step S7. Thus, the operations of the image formation units of the respective colors are controlled. Note that the processing including step S5, the determination as NO in step S6, and step S7 may be also referred to as the "ordinary color misregistration correction operation".

At the second and the subsequent round of the color misregistration correction command (at time points t2 and t3) counted from the point of detection (step S5) of the start of continuous printing (at time point t0 in FIG. 8B), the temperature inside the apparatus is saturated (the temperature is in an almost constant state). This means that the amount of color misregistration tends to be small compared to the first round, and thus the determination in step S6 usually becomes YES and the color misregistration correction operation in step S7 is not executed. In this case, after the color misregistration detection of the first process is executed in step S5, the color misregistration correction of the first process, and the second and third processes are not executed. Note that the processing including step S5 and the determination as YES in step S6 may be referred to as the "simplified color misregistration check".

Regardless of the size of the amount of color misregistration, the ordinary color misregistration correction operation requires a period of several ten seconds. For this reason, it is not possible to perform the printing on the record media during this period. In the comparative example in FIG. 3A, the ordinary color misregistration correction operation is executed even in the case where the detected amount of color misregistration is sufficiently small and the ordinary color misregistration correction operation is not necessary. As a consequence, printing efficiency (a printing speed) in the continuous printing is deteriorated and a large time loss is incurred.

Accordingly, in this embodiment, as illustrated in FIG. 8B, the ordinary color misregistration correction operation does not necessarily take place every time after printing the predetermined number of sheets during the continuous printing. Instead, the ordinary color misregistration correction operation is not performed if the amount of color misregistration falls below the predetermined value (i.e., a simplified color misregistration check is applied). The simplified color misregistration check is the control in which the number of combinations of colors to be measured for the amount of color misregistration is reduced as compared to the color misregistration correction operation. The color misregistration correction control in the comparative example illustrated in FIG. 8A is designed to carry out the ordinary color misregistration detection operation each time which executes the color misregistration detection and the color misregistration correction between the black (K) correction patterns and the cyan (C) correction patterns (K-C color misregistration detection and correction), the color misregistration detection and the color misregistration correction between the black (K) correction patterns and the magenta (M) correction patterns (K-M color misregistration detection and correction), and the color misregistration detection and the color misregistration correction between the black (K) correction patterns and the yellow (Y) correction patterns (K-Y color misregistration detection and correction).

On the other hand, in the processing of this embodiment illustrated in FIG. 8B, control unit 81 detects the amount of color misregistration between the reference color K and the color C, and determines whether the ordinary color misregistration correction operation is to be carried out (NO in step S6) or not to be carried out (YES in step S6). In other words, the amount of color misregistration between the image formation unit of the reference color K located at the uppermost stream among the multiple image formation units and the image formation unit of cyan (C) located at the downmost stream among the multiple image formation units is detected (step S5). If the amount of color misregistration between K-C is smaller than a predetermined given value, the next printing operation is started immediately without carrying out the ordinary color misregistration correction operation (step S7). The predetermined given value is a value which is half as large as a specification value of the amount of color misregistration. If the amount of color misregistration turns out to be equal to or above the value half as large as the specification value of the amount of color misregistration as a result of checking the amount of color misregistration in step S5, then the amount of color misregistration between K-Y and the amount of color misregistration between K-M are detected, and then the color misregistration correction for each color is executed.

As a matter of fact, when image formation apparatus 1 is performing a large amount of continuous printing, the temperature inside the apparatus almost reaches a state of saturation at a higher temperature than room temperature, whereby temporal changes in dimensions of the drive system are expected to be reduced. At this time, a temporal change in amount of color misregistration when the number of sheets counted from the previous color misregistration correction command reaches a prescribed consecutive number of sheets (400 sheets), is expected to be very little. Accordingly, in the simplified color misregistration check to carry out only the detection of color misregistration between K-C, if the amount of color misregistration is equal to or below the predetermined value (a prescribed value), then it is not necessary to perform the ordinary color misregistration correction operation that requires a relatively long period, so that the printing operation can be resumed promptly. Thus, it is possible to reduce the time loss and to improve productivity of printed matters.

When the amount of color misregistration is below the predetermined value (below the value half as large as the specification value of the amount of color misregistration), control unit 81 advances the processing to step S8 without executing the ordinary color misregistration correction operation (step S7). On the other hand, when the amount of color misregistration is equal to or above the predetermined value, control unit 81 executes the ordinary color misregistration correction operation, and then advances the processing to step S8 to determine whether or not the printing is completed. The processing is terminated when the printing is completed. If the printing is not completed, control unit 81 returns the processing to step S4.

<<1-3>> Effects

As described above, according to image formation apparatus 1, only the amount of color misregistration between K-C (between the two image formation units located most distant from each other) representing the harshest condition is measured at the timing to execute the color misregistration correction command (every time 400 sheets are printed, for example). Then, the ordinary color misregistration correction operation is skipped when the measured value is equal to or below the prescribed value (YES in step S6 in FIGS. 8B and 9). This makes it possible to reduce a period in which the printing cannot be executed during the execution of a large amount of continuous printing, i.e., to reduce a time loss, thereby achieving an effect of improvement in printing efficiency (productivity of printed matters).

<<2>> Second Embodiment

Figure 10:
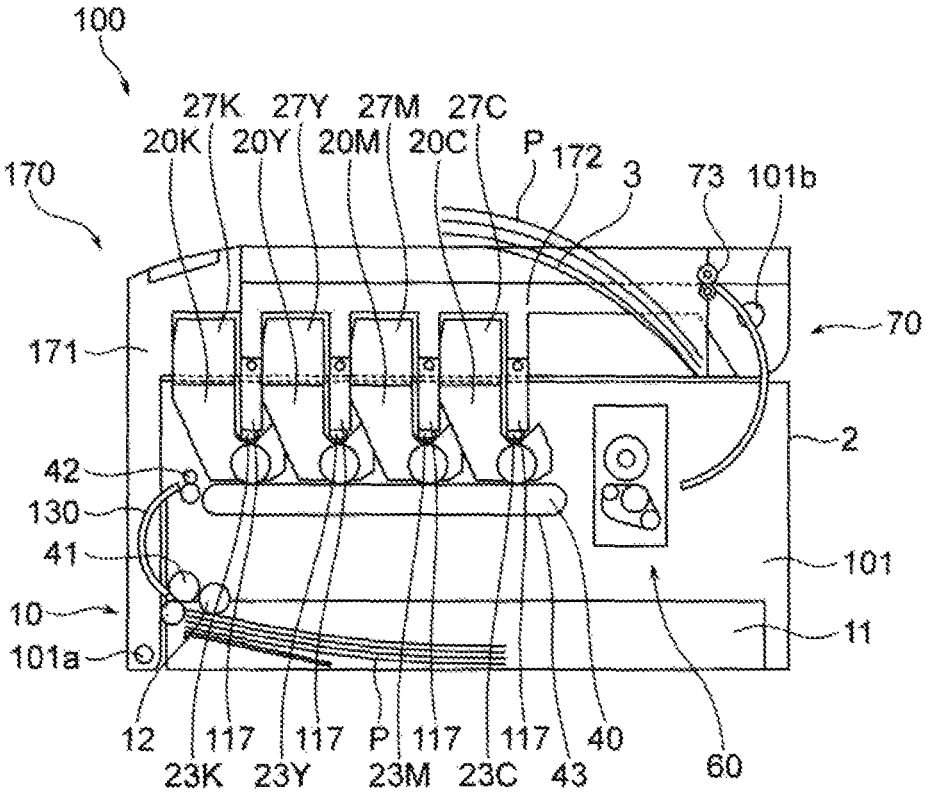
FIG. 10 is a cross-sectional view illustrating a schematic configuration of an image formation apparatus according to one or more embodiments.
Figure 11:
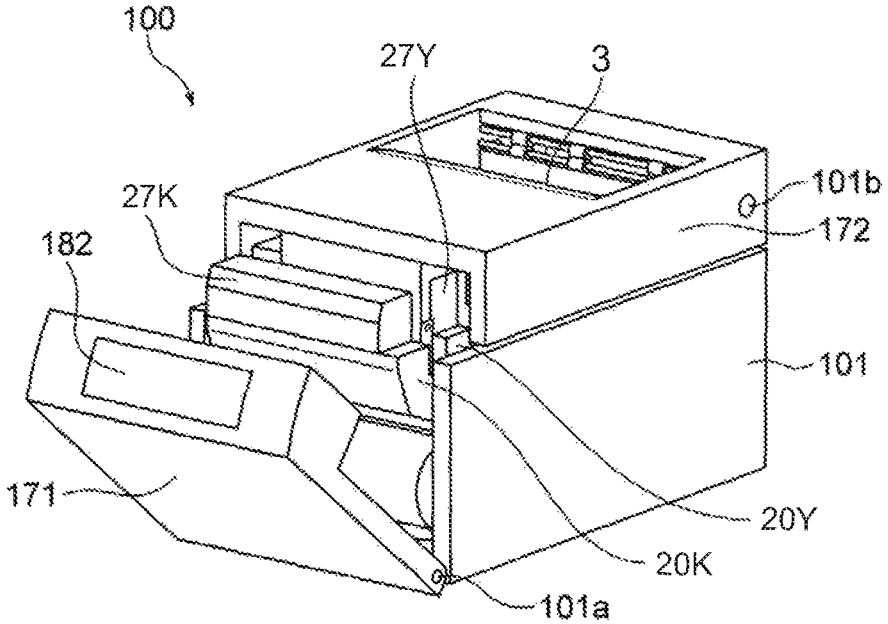
FIG. 11 is a perspective view illustrating the schematic configuration of the image formation apparatus.
Figure 12:
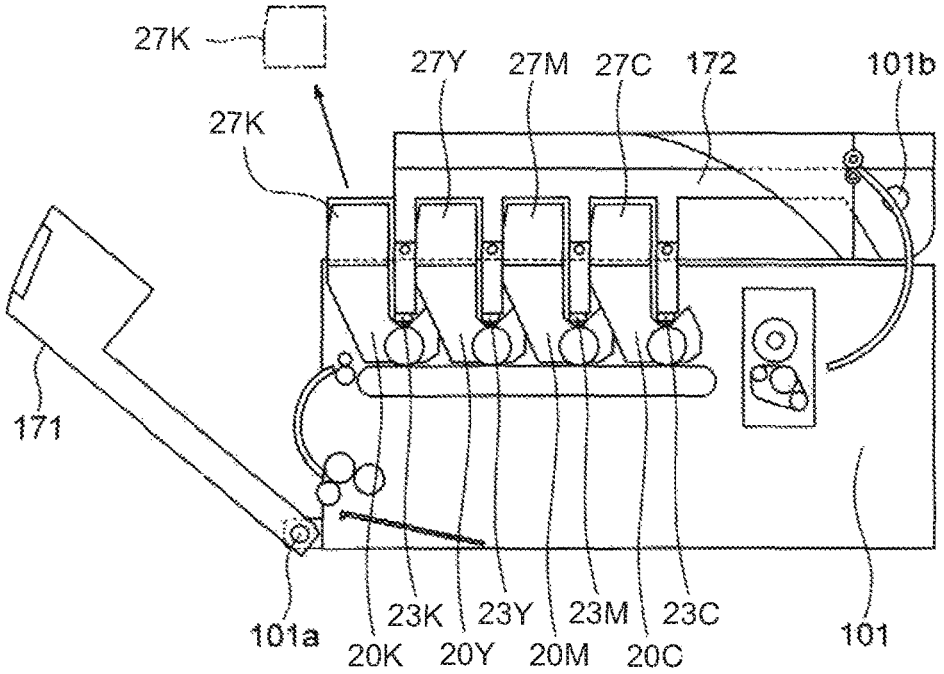
FIG. 12 is another cross-sectional view illustrating the schematic configuration of the image formation apparatus.

FIG. 10 is a cross-sectional view illustrating a schematic configuration of image formation apparatus 100 according to one or more embodiments. FIG. 11 is a perspective view illustrating the schematic configuration of image formation apparatus 100. FIG. 12 is another cross-sectional view illustrating the schematic configuration of image formation apparatus 100. In FIGS. 10, 11, and 12, constituents which are identical or corresponding to the constituents illustrated in FIG. 1 are denoted by the same reference numerals as those indicated in FIG. 1.

Image formation apparatus 100 is different from image formation apparatus 1 in that image formation apparatus 100 includes first cover 171 serving as an opening-closing member to open and close an opening of housing 2. As illustrated in FIGS. 11 and 12, image formation apparatus 100 includes the opening, housing 2 to house the multiple image formation units attached to the apparatus body, and first cover 171 serving as the opening-closing member that sets the opening to either an open state or a closed state. The opening in the open state has such a shape that makes the black image formation unit attachable to and detachable from the apparatus body via the opening, and makes the image formation units other than black not attachable to or detachable from the apparatus body. Except for this feature, the second embodiment is the same as the first embodiment.

External cover unit 170 is a portion that covers apparatus body 101. External cover unit 170 includes first cover 171 and second cover 172. To be more precise, image formation apparatus 100 is provided with two covers 171 and 172, which can open and close portions of an upper part of image formation apparatus 100 (or apparatus body 101) separately.

First cover 171 is a cover which is designed to cover particular toner cartridge 27K out of multiple toner cartridges 27K, 27Y, 27M, and 27C, and is made openable so as to enable attachment and detachment of particular toner cartridge 27K. Specifically, first cover 171 is openably and closably provided to apparatus body 101, and is designed to cover particular toner cartridge 27K in the closed state and to enable attachment and detachment of particular toner cartridge 27K in the open state.

In this embodiment, the particular toner cartridge is black toner cartridge 27K which is used most frequently. As illustrated in FIGS. 11 and 12, only black toner cartridge 27K is made attachable and detachable by opening first cover 171.

Meanwhile, first cover 171 is designed to cover an apparatus upper part and apparatus side parts (or apparatus perpendicular surface parts) in the closed state, and to open the apparatus upper part and the apparatus side parts in the open state. Here, the apparatus upper part and the apparatus side parts are an upper part and side parts of image formation apparatus 100 or apparatus body 101.

Moreover, first cover 171 is designed to cover conveyance unit 130 in the closed state and to open conveyance unit 130 in the open state.

Specifically, first cover 171 is a cover having an L-shaped cross section so as to cover the apparatus upper part and an apparatus front face part. As first cover 171 is opened to a front side of the apparatus, first cover 171 opens the apparatus upper part and the apparatus front face part, thereby exposing toner cartridge 27K (or image formation unit 20K) as well as conveyance unit 130. To be more precise, first cover 171 is turnably attached to apparatus body 101, and is made openable and closable by means of turning motions. In FIGS. 10 and 11, first cover 171 is supported turnably around pivot 101*a*, which is disposed at a lower end part on a front side of apparatus body 101 and extends in the right-left direction.

Second cover 172 is a cover which is designed to cover toner cartridges 27Y, 27M, and 27C (remaining toner cartridges) other than particular toner cartridge 27K mentioned above out of multiple toner cartridges 27K, 27Y, 27M, and 27C, and is made openable so as to enable attachment and detachment of remaining toner cartridges 27Y, 27M, and 27C. Specifically, second cover 172 is openably and closably provided to apparatus body 101, and is designed to cover remaining toner cartridges 27Y, 27M, and 27C in the closed state, and to enable attachment and detachment of the remaining toner cartridges in the open state.

Specifically, second cover 172 is a cover that covers the apparatus upper part. As second cover 172 is opened to an upper side of the apparatus, second cover 172 opens the apparatus upper part, thereby exposing toner cartridges 27Y, 27M, and 27C (or image formation units 20Y, 20M, and 20C). To be more precise, second cover 172 is turnably attached to apparatus body 101, and is made openable and closable by means of turning motions. In FIGS. 10 to 12, second cover 172 is supported turnably around pivot 101*b*, which is disposed at an upper end part on a rear side of apparatus body 101 and extends in the right-left direction.

In addition, second cover 172 includes a fixation unit, which fixes image formation units 20K, 20Y, 20M, and 20C in the closed state of second cover 172, and to release the fixed state of image formation units 20K, 20Y, 20M, and 20C in the open state of second cover 172. Specifically, second cover 172 holds print heads which form electrostatic latent images to be developed by image formation units 20K, 20Y, 20M, and 20C. The print heads are engaged with image formation units 20K, 20Y, 20M, and 20C in the closed state of second cover 172, and recede from image formation units 20K, 20Y, 20M, and 20C in the open state of second cover 172, thus functioning as the aforementioned fixation unit. To be more precise, optical heads 23K, 23Y, 23M, and 23C as many as corresponding image formation units 20K, 20Y, 20M, and 20C mentioned above are held through head holders 117, respectively. Each head holder 117 is turnably supported by second cover 172 at hinged support 172*a*, and is thus made turnable within a restricted range relative to second cover 172.

As the printing operations are repeated, the developers in the toner cartridges are gradually consumed. When the developer inside black toner cartridge 27K is consumed and toner cartridge 27K needs to be replaced, image formation apparatus 100 outputs a message to information display unit 182 in order to prompt a user to replace black toner cartridge 27K. Then, the operations of the apparatus are temporarily stopped. In this case, the user opens first cover 171 as illustrated in FIGS. 11 and 12. Thus, only the black toner cartridge 27K is opened. Next, the user replaces black toner cartridge 27K and closes first cover 171. Here, first cover 171 is reduced to a smaller size as compared to a conventional cover designed to entirely cover the four image formation units. Accordingly, it is possible to open and close first cover 171 more easily than opening and closing the conventional cover.

When any of Y-, M-, and C-color toner cartridges 27Y, 27M, and 27C needs to be replaced, the user opens first cover 171 as illustrated in FIG. 11, then opens second cover 172 illustrated in FIG. 12, and replaces the targeted toner cartridge. After the replacement, the user closes second cover 172, and then closes first cover 171. Here, second cover 172 is reduced to a smaller size as compared to the conventional cover designed to entirely cover the four image formation units. Accordingly, it is possible to open and close second cover 172 more easily than opening and closing the conventional cover.

When a record medium is jammed in conveyance unit 130, the user opens first cover 171, and then opens conveyance unit 130 to remove jammed record medium P. In other words, first cover 171 is used as the cover to be opened when replacing black toner cartridge 27K and also as the cover to be opened when removing the jammed record medium P.

According to the second embodiment, image formation apparatus 100 includes: first cover 171 which covers a particular toner cartridge among multiple toner cartridges, and is made openable so as to enable attachment and detachment of the particular toner cartridge; and second cover 172 which covers the remaining toner cartridges, and is made openable so as to enable attachment and detachment of the remaining toner cartridges. According to the second embodiment, the size of each of the covers can be reduced as compared to a configuration including the cover that entirely covers the multiple toner cartridges. Thus, it is possible to diminish opening and closing operations of the covers when replacing the toner cartridges. In this way, it is possible to facilitate the opening and closing operations of the covers when replacing the toner cartridges, for example, thereby reducing workloads at the time of replacement of the toner cartridges.

<<3>> Modified Examples

Although the invention has been described above by using an electrophotographic printer as an example, the invention is also applicable to a multifunction peripheral provided with a scanner function or a facsimile function.

Moreover, the invention is also applicable to an apparatus including an intermediate transfer belt as a transfer target medium to which developer images are transferred, and a secondary transfer unit which transfers the developer images on the intermediate transfer belt onto a record medium.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation apparatus comprising:

a first image formation unit containing a first developer;

a second image formation unit disposed downstream of the first image formation unit in a traveling direction of a transfer target medium, the second image formation unit containing a second developer;

a third image formation unit disposed downstream of the second image formation unit in the traveling direction, the third image formation unit containing a third developer;

a detector configured to detect a first correction pattern formed on the transfer target medium by the first image formation unit, a second correction pattern formed on the transfer target medium by the second image formation unit, and a third correction pattern formed on the transfer target medium by the third image formation unit; and a control unit programed to control image misregistration correction based on a result of detection by the detector, wherein the control unit causes the first image formation unit to form the first correction pattern on the transfer target medium, and causes the third image formation unit to form the third correction pattern on the transfer target medium, and when an amount of image misregistration between the first correction pattern and the third correction pattern is less than a predetermined value, the control unit neither causes the second image formation unit to form the second correction pattern, nor executes the image misregistration correction.

2. The image formation apparatus according to claim 1, wherein when the amount of image misregistration between the first correction pattern and the third correction pattern is equal to or greater than the predetermined value, the control unit causes the second image formation unit to form the second correction pattern, and executes the image misregistration correction.

3. The image formation apparatus according to claim 2, wherein the control unit executes the image misregistration correction based on the result of detection of the first correction pattern, the second correction pattern, and the third connection pattern.

4. The image formation apparatus according to claim 2, wherein the first image formation unit is located at the uppermost stream in the traveling direction among image formation units including the first to third image formation units, and the third image formation unit is located at the downmost stream in the traveling direction among the image formation units including the first to third image formation units.

5. The image formation apparatus according to claim 1, further comprising:

a housing which includes an opening, and houses the first to third image formation units attached to an apparatus body; and a cover configured to open and close the opening, wherein when the opening is in the open state, the first image formation unit is made attachable to and detachable from the apparatus body via the opening, and the third image formation unit is not attachable to or detachable from the apparatus body.

6. The image formation apparatus according to claim 5, wherein the opening is formed into a shape with which, when the opening is in the open state, the first image formation unit is made attachable to and detachable from the apparatus body via the opening, and the third image formation unit is not made attachable to or detachable from the apparatus body.

7. The image formation apparatus according to claim 1, wherein the first developer is a black developer.

8. The image formation apparatus according to claim 1, wherein the first developer, the second developer, and the third developer are developers of colors that are different from one another.

9. The image formation apparatus according to claim 8, wherein the image misregistration correction is color misregistration correction.

10. The image formation apparatus according to claim 1 wherein in response to a misregistration correction command during a continuous printing by the image formation units, the control unit:

suspends the continuous printing;

causes the first image formation unit to form the first correction pattern on the transfer target medium, and causes the third image formation unit to form the third correction pattern on the transfer target medium; and resumes the continuous printing without causing the second image formation unit to form the second correction pattern and without executing the image misregistration correction, when the amount of image misregistration between the first correction pattern and the third correction pattern is less than the predetermined value.

* * * * *